US008870185B2

(12) United States Patent
Cheng

(10) Patent No.: US 8,870,185 B2
(45) Date of Patent: Oct. 28, 2014

(54) BUILDING BASE PLATES ASSEMBLED TO BUILD BLOCKS SET IN CUBE DIMENSIONAL CONFIGURATIONS

(76) Inventor: Ming-Hsien Cheng, Taipei (TW)

( * ) Notice: Subject to any disclaimer, the term of this patent is extended or adjusted under 35 U.S.C. 154(b) by 473 days.

(21) Appl. No.: 13/210,376

(22) Filed: Aug. 16, 2011

(65) Prior Publication Data

US 2013/0043654 A1 Feb. 21, 2013

(51) Int. Cl.
*A63F 9/12* (2006.01)
*A63F 3/00* (2006.01)

(52) U.S. Cl.
CPC ..... *A63F 3/00003* (2013.01); *A63F 2003/0081* (2013.01); *A63F 2003/00394* (2013.01); *A63F 3/00574* (2013.01); *A63F 2003/00217* (2013.01); *A63F 2003/0094* (2013.01)
USPC ..... 273/281; 273/276; 273/282.1

(58) Field of Classification Search
USPC ..... 273/269, 282.1, 282.3, 287, 288, 276, 273/281; 446/118
See application file for complete search history.

(56) References Cited

U.S. PATENT DOCUMENTS 2,905,473 A * 9/1959 Giannotti ..... 273/238
3,606,333 A * 9/1971 Green ..... 273/239
3,792,866 A * 2/1974 Dreyer et al. ..... 273/258
3,804,415 A * 4/1974 Ryan ..... 273/275
4,629,192 A * 12/1986 Nichols ..... 273/156
4,988,103 A * 1/1991 Cheng ..... 273/157 R
5,649,703 A * 7/1997 Kanbar ..... 273/157 R
5,685,120 A * 11/1997 Sihra ..... 52/604
5,823,533 A * 10/1998 Edwards ..... 273/160
6,220,919 B1 * 4/2001 Cheng ..... 446/117
6,893,020 B1 * 5/2005 Snyder ..... 273/290
6,983,937 B2 * 1/2006 Levinson ..... 273/309
8,020,867 B2 * 9/2011 Cheng ..... 273/157 R
8,480,449 B2 * 7/2013 Cheng ..... 446/124
8,567,785 B1 * 10/2013 Cheng ..... 273/287
2007/0187890 A1 * 8/2007 Cheng ..... 273/153 P
2008/0274665 A1 * 11/2008 Cheng ..... 446/118
2013/0277914 A1 * 10/2013 Cheng ..... 273/287

* cited by examiner

*Primary Examiner* — William Pierce

(57) ABSTRACT

A game apparatus for allowing players to turnover building blocks, including block and flat for overturn, which are characterized in that: the building block is consisted of two to eight cubes, including at least eight corners and twelve ridges; the ridges are designed with balls outside and every balls has the same diameter outside; the flat has the same distance with the hole, which is a dimple, and the distance between two holes equals to the side length of cube ball; thus balls of the building block can function with hole and makes building block stands on the flat after the ball is inserted into the hole; the building block can work with any two balls as rotate axis to rotate 90 degrees of front, back right and left side on the flat; through many times of overturn, the building block can go from beginning place to the end and reach the effect of fun competition and brain exercise.

10 Claims, 12 Drawing Sheets

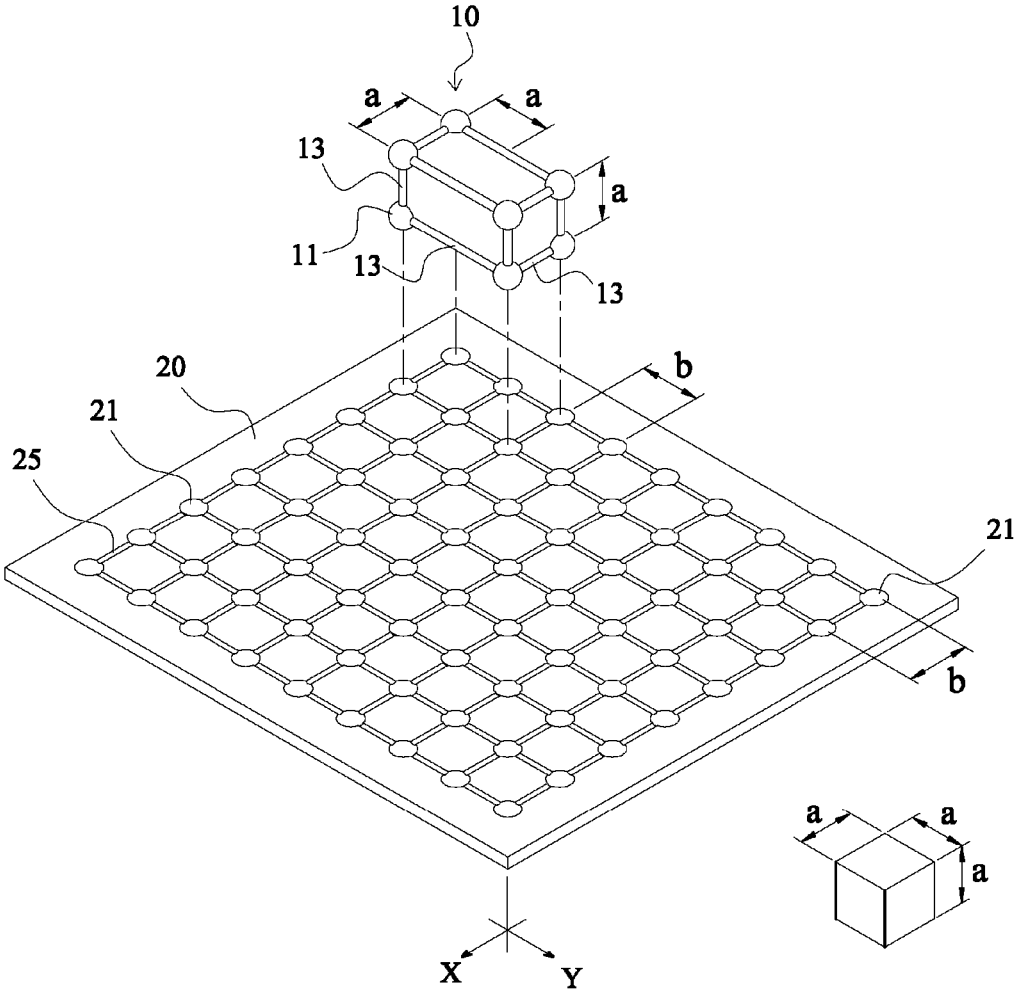
Fig.1-1
Fig.1-4
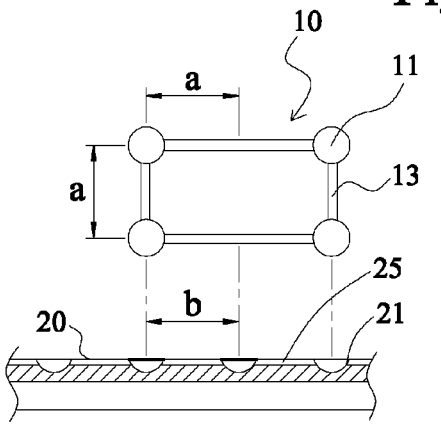
Fig.1-2
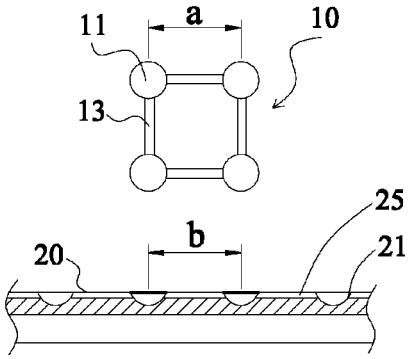
Fig.1-3

BUILDING BASE PLATES ASSEMBLED TO BUILD BLOCKS SET IN CUBE DIMENSIONAL CONFIGURATIONS

FIELD OF THE INVENTION

This invention involves a design which makes the building block overturn.

DESCRIPTION OF PRIOR ARTS

Many designs of building blocks move only flat, but the applicant invented a kind of turnover building blocks; the players can show their smartness by moving this set of building block less, which motivate the players as well.

In order to overturn the building blocks, players have to think:

1. Overturn direction: Whether it is in right or slash way; if the overturn is in right way, the building blocks have to move on vertical axis, the X axis, or horizontal axis, the Y axis; if the overturn is in slash way, there should be overturn in 45 angles;
2. Overturn angles: If the building block is cube, it should be overturn in 90 angles; if the building block is in flat, it should be overturn in 180 angles; this overturn angles are concerned with the ways to play;
3. The shape of Building Block: The cube is consisted of many units, which are in cube, ball or other forms; its shape and number changes with the units and the number of cubes.
4. Flat Shape: Flat provides a base for the overturn of cubes, and there are many kind of flat shapes such as square, rectangle, triangle. Once the shape of flat changes, the methods to play this building blocks is different;
5. The bump place: The bump is set on the flat; it will be more difficult to play the game if the number of bumps added; the position, and numbers on the flat have to be planned in advance;

There are different ways and levels of playing this set of building block according to the 5 points mentioned above; in this way, the players are motivated and the methods to play this game becomes the central topic.

SUMMARY OF THE INVENTION

This invention is invented in the way that a set of overturn building block cube, including building block (10) which is consisted of two to eight cubes, including at least eight corners and twelve ridges; said ridges is designed with balls (11) and every balls (11) has the same diameter outside; said flat (20) has the same distance with said hole (21), which is a dimple, and the distance (b) between two holes (21) equals to the side length (a) of cube ball (11); thus balls (11) of the building block (10) can function with hole (21) and makes building block (10) stands on the flat (20) after the ball (11) is inserted into the hole (21); said building block (10) can connect with any two balls (11) as rotate axis to rotate 90 degrees on any two holes (21) with front, back, right and left side on the flat (20).

According to the description above, said flat (20) designs a said bump (22) to impede the building block (10); said building block (10) has correspondence bump (22) for gap (12).

According to the description above, said flat (20) is designed to be hollow (23); there are many marks (31) on the card (30), placed under flat (20); people can see card (30) and its marks (31) through hollow (23), and this invention makes at least two marks (31) to be the imaginary bump (32) to impede the turnover of building block (10).

According to the description above, said flat (20), printed with lots of marks (31), is transparent and card (30) is placed under flat (20); through transparent flat (20), people can see the surface of marks (31) on card (30); there are at least two marks (31) to be the imaginary bump (32) of building block (10).

According to the description above, said flat (20) is designed with card box (40) with many cards (30) in it; the base of said card box (40) has a frame slot (41) to place building block (10).

According to the description above, said flat (20) is designed with a cover (50) to close, and on the inside part of said cover (50) have a frame slot (51) to place building block (10); building block (10) is placed inside cover (50).

According to the description above, twelve corners are replaced with arc line (13) and said flat (20); hole (21) are connected with arc groove (25); said arc line (13) and arc groove (25) can correspond with each other.

According to the description above, the shapes of cube (10) are selected from the following:

First building block (101) is composed of two connected cubes;

Second building block (102) is composed of three connected cubes;

Third building block (103) is composed of four connected cubes;

Fourth building block (104) is composed of six connected cubes;

Fifth building block (105) is composed of eight connected cubes;

Sixth building block (106) is composed of five connected cubes and one unit of open gap (12);

Seventh building block (107) is composed of six connected cubes and two unit of open gap (12);

Eighth building block (108) is composed of seven connected cubes and one unit of open gap (12);

According to the description above, it is characteristic in that:

Every building block (10) is composed two to eight cubes and each cube contains at least eight corners and twelve ridges, which are replaced the protruding balls (11); the side length of a cube equals to the distance of two bump (21) on flat (20), so each ball (11) of cube (10) can work with hole (21) of flat (20).

Each ball (11) of cube (10) is inserted into holes (21) on flat (20) to make cube (10) place on flat (20); when cube (10) use any of two balls (11) as axis, it can rotate 90 degrees on any two holes (21) of flat (20).

Said flat (20) designs a said bump (22) to impede the building block (10); it will be more difficult if building block (10) hinder by more and more bump (22) and vise versa; the difficulty level can change according to the number of bump (22) for building block (10) to motivate players.

Said flat (20) is designed to be hollow (23) between every hole (21) of every four square; there are many marks (31) on the card (30), placed under flat (20); people can see card (30) and its marks (31) through hollow (23), and this invention makes at least two marks (31) to be the imaginary bump (32) to impede the turnover of building block (10); the level of difficulty increases when overturn to reach the effect of fun.

Said flat (20), printed with lots of marks (31), is transparent and card (30) is placed under flat (20); through transparent flat (20), people can see the surface of marks (31) on card (30), and every marks (31) corresponds to the square of bump (21) which makes at least two marks (31) to be the imaginary bump (32) of building block (10); the difficulty arises when overturn to reach the effect of fun.

There are many cards (30) and each card (30) has two imaginary bumps (32) on different positions; there is a card box (40) under flat (20) to place cards (30); the players can change the cards (30) in card box (40) anytime; the card drawn out can be placed on top of card (30), close to flat (20), and easy to see; flat (20) can protect from dust with cover (50) on top.

In addition, the frame slots (41, 51) disposed on the card box (40) or cover (50) for cube (10) being embedded; thus cube (10) can be placed within card box (40) or cover (50) to hide and can prevent from loss.

DETAILED DESCRIPTION OF THE PREFERRED EMBODIMENTS

FIG. 1-1: shows a decomposition of this overturn building block invention; a building block (10) is a representative which is characteristic in that: building block (10) is consisted of at least two to eight cubes with at least eight corners and twelve edge lines, and said corner is replaced by protruding balls (11) with the same diameter outside; said holes (21) are arranged in the array method on said flat (20) and balls of the building block (10) can function with hole (21), which makes building block (10) stands on the flat (20).

FIG. 1-4: shows the view of a cube, which contains six same faces, and each side length of cube cell is the same; this invention eliminates different shape of cube and said cube overturn in only 90 degrees without 180 degrees.

FIG. 1-1, FIG. 1-2 and FIG. 1-3 shows that the building blocks (10) is consisted of two cubes and each length (a) of cube unit equals to the distance (b) of each two holes (21) on flat (20); the length relation is: (a)=(b); in this way, each ball (11) on building block can match with each hole (21) on flat (20).

There are different shapes of cubes above mentioned, as FIG. 21 shows, there are eight different building blocks (101 to 108), and each building block of width (W) equals to the distance (b) of two holes (21); by math forms: (W)=(a)=(b).

The length of blocks (L) and the height of blocks (H) are different; from length view:

The length (L) of blocks (101 and 103) equals the side length of cube ball (a), which also equals to the distance (b) of three holes (21); by math forms: (L)=2(a)=2(b).

The length (L) of blocks (102, 104 and 106) equals to the length (L) of three cube cells (a); which also equals to the distance among three holes (21); by math forms: (L)=3(a)=3(b).

The length (L) of blocks (105, 107 and 108) equals to the length (L) of four cube cells (a); which also equals to the distance among four holes (21); by math forms: (L)=4(a)=4(b).

From height view:

The height (H) of blocks (101 and 102) equals to the height (H) of one cube cell (a), which also equals to the distance between two holes (21); by math forms: (L)=(a)=(b).

The height (H) of blocks (103 to 108) equals to the height (H) of two cube cells (a); which also equals to the distance among three holes (21); by math forms: (L)=2(a)=2(b).

According to the mentioned above, each hole (21) on flat (20) corresponds to arc groove (25); said arc groove (25) corresponds to arc lines (13), so arc line (13) will be laid on arc groove (25) when overturn; without the design of arc line (13), there is no need for arc groove (25).

According to the mentioned above, building block (10) overturn with the rotation axis of two balls (11) on each corner lines; each two holes (21) can match with flat (20) to make only 90 degrees without any other angle; it can be seen from FIG. 2-1 to FIG. 2-6; (A) in FIG. 2-1 to FIG. 2-6 shows the start position (A), and the (B) is the complete position of building blocks (10); said start position and complete position are decided by players and building block (10) has to start from start position (A) to complete position (B) with times of 90 degrees overturn; eg. there are many ways to play this game from FIG. 2-1 to FIG. 2-6, from start position (A) to complete position (B); the winners can take the least overturn to finish; the fig. shows only one of the methods to play and once the start position (A) and complete position (B) changes, the difficulty of this game changes.

Said building blocks (10) are characteristic in that:

1. Building block is in the shape of cuboid, and there are composed of at least two cubes;
2. Building block overturn in the position of 90 degrees;
3. Building block can only move in straight; eg. front, back, right and left overturn without 45 degrees of slash overturn;
4. Building block can overturn with the axis of each two balls (11) on each ridges of each two holes (21) on flat (20).

In addition, the corners of building block (10) are replaced by protruding balls (11), and the building block is characteristic in that:

1. Balls (11) are easy to be placed on holes (21) of flat (20); in this way, the surface of building block (10) can be placed on flat (20);
2. holes (21) are shallow arcs and balls (11) are easy to overturn with little obstruction on shallow arc;
3. Balls (11) are placed on holes (21) so it is not easy to rotate; even though the shake of flat (20), the balls (11) are placed steady on holes (21);
4. Protruding balls (11) can reach the function of safety and makes building block (10) safe without scratch.

Moreover, the ridges of building block (10) are replaced by the protruding arc lines, and the building block (10) is characteristic in that:

1. Arc lines (13) are easy to be placed on the arc grooves of flat (20) to make the surface of building block (10) placed on the flat (20);
2. Arc lines (13) are not easy to rotate in arc grooves (25); even though the shape of flat (20), arc line (13) are placed steady on arc grooves (25);
3. Protruding arc lines (13) can reach the function of safety without scratch and makes building blocks (10) without any edges shown outside.

FIG. 3 and FIG. 4: shows view of the movement of this building block; FIG. 3 shows the building block (10) on flat (20) of its start position (A) and complete position (B) on the diagonal, and FIG. 4 shows building block (10) on flat (20) of its start position (A) and complete position (B) not on the diagonal; it can be inferred from two embodiment examples that start position (A) and complete position (B) can be in any position of flat (20) without being limited on FIG. 3 and FIG. 4; thus start position (A) and complete position (B) can be decided by players. After players move the building block (10) from start position (A) to complete position (B), they finish the game; the winners are those who move with fewest overturn times. In this way, this game is fun, creativity, competitive to players, and can motivate players.

FIG. 5: shows the two bumps (22) to impede building block (10) on flat (20) and the bumps (22) are placed inter every four holes (21); said area of said bump (22) equals top one unit of cube.

And the shapes of bump (22) are not limited but the height is no more than the side length of cube cell (a), and the number of bump (22) should contains at least on unit; the numbers of bumps (22) can be added, and this game will be more difficult if the number of bumps (22) added with the overturn building block (10) on flat (20); the position of bump (22) can be fixed or not, if not, the position of bump (22) can be placed anywhere on flat (20).

As reference to FIG. 6; said bump (22) is the obstacle point of this game, and to make this game fun and have creativity, the inventor makes a gap (12) to the building block (10); take FIG. 6 for example, building block (10) is consisted of five cubes, and contains a gap (12) outside; the area of the gap (12) equals to the area of the bump (22); the overturn of building block (10) can hide away from bump (22) by gap (12) or bypass on two sides of the bump (22) to the complete position (B); building block (10') in the FIG. 6 shows the complete position of this game.

As reference to FIG. 7, there are two bumps (22) or the flat (20), according to FIG. 6, and the sum of bumps (22) are four; when building block (10) goes start from start position (A) to complete position (B), it has to hide away from these four bumps (22); building block (10) can bypass through two sides of the bump (22) or hide away from bump (22) by the gap (12); the difficult of FIG. 7 is higher than FIG. 6.

It can be inferred from the idea that the design of bumps (22) are harder than the design without bumps (22); once the number of bumps (22) increased, the difficulty of this game increases; moreover, building block (10) are consisted of two to eight unit of cubes; once the number of cubes increased, the bulk of building blocks (10) increased, which will make this game harder; whenever the gap (12) is designed on building block (10), the fun of this game increases.

In order to make bump (22) move freely on flat (20), bumps (22) are made to be the moving parts; ie. bumps (22) can change its position on flat (20); as FIG. 7 shows, said flat (20) is designed to be hollow (23) between every hole (21) of every four square; the bottom of bump (22) can be inserted with hollow (23), and there are many ways of insertion, which are not stated here; the bump (22) can also be taken out from hollow (23) to change position for the purpose of motivating players.

According to the mentioned above, the bump (22) is the obstacle on flat (20) and can also be practiced on FIG. 8; as FIG. 8 shows, there are many marks (31), which are Arab numbers or symbols on front and back side on a card (30); for example, marks (31) is Arab numbers and choose two or more numbers from marks (31) as the imaginary bump (32); the imaginary bump (32) are shown on Arab numbers of round brackets. Said card (30) can work with flat (20) and explained on FIG. 9 and FIG. 10.

FIG. 9 and FIG. 10 shows the exploded and schematic view of card and flat; in FIG. 9, cards (30) are placed under flat (20), and the marks (31) on card (30) corresponds to each hollow (23); thus players can see the marks (31) and each hollow (23) through each hollow (23) of card (30) as FIG. 11 shows; the overturn of building block (10) on flat (20) can hide away from imaginary bump (32) with gap (12) or bypass the two sides of imaginary bump (32) with gap (12). Thus, it can be inferred that bump (22) can be replaced by imaginary bump (32) of card (30).

FIG. 12 shows the view of flat and card from naked eyes; FIG. 12 is different from FIG. 11 that there is no hollow (23) on flat (20); card (30) is placed under flat (20) and each marks (31) on the card are placed among every four holes (21) arranged in matrix; thus players can see marks (31) and imagery bump (32) through flat (20) on card (30) with naked eyes; the structure can be explained in FIG. 13.

Cards (30) are placed under flat (20) in FIG. 13, and many marks (31) on cards (30) are placed among every four holes (21), arranged in matrix forms; in FIG. 14, when flat (20) and cards (30) are combined, players can see marks (31) and imaginary bump (32) on cards (30) through holes (21); the imaginary bump (32) can replaced with substantial bump (22).

According to the description above, bump (22) and imaginary bump (32) are the obstacle of building block (10), and can also be the start position and complete position as FIG. 6 shows; two bumps (22) can be the start and, complete position of building block (10) on flat (20), so imaginary bump (32) can be the start and complete position of building block (10) on flat (20).

FIG. 15 shows the 3-Dimensional view of connection of flat, cover, and card box, FIG. 16 shows 3-Dimensional assemble view of FIG. 15 and FIG. 17 shows the X-X cutaway view of FIG. 16; there are many said cards (30) and can be placed in card box (40) and card box (40) is under flat (20). Said flat (20) is provided with the cover (50) to protect it from dust, and the frame slot (51) to place each building block (10). Said flat (20), card box (40) and cover (50) are connected with each other on one side of bolt, which is traditional art and not stated here; said cover (50) has the function of open and close, and flat (20) has the same function of open and close; when the close of said flat (20), card box (40) and cover (50), it is shown in FIG. 16 as a box. In addition, FIG. 17 shows, building block (10), bump (22) and many cards (30) hidden inside this portable box, which is easy to save and prevent from loss.

FIG. 18 shows the 3-Dimensional assemble of flat with another card box, FIG. 19 shows the 3-Dimensional view of FIG. 18 after assemble, and FIG. 20 shows the Y-Y cutaway view of FIG. 19; this example is different from FIGS. 15 to 17 in that: this example without a cover (50) but said card box (40) are equipped with front slot (41) of building block (10) to make building block (10) hid inside card box (40); said many cards (30) are piled above front slot (41) and building block (10), so the depth of this card box (40) example is more than the example above. Said front slot (41) is designed according to the number of building block (10); for example, if there are different shapes of building block (10), there should be two front slots (41). From this example, even without the cover (50), it can be a portable box.

This set of building blocks contains many types of embodiments, as FIG. 21 shows that there are eight different shape of building block (10), which contains two layers on up and down side, and the width (W) of it equals to the distance (b) of two holes (21); the shapes chosen are as follows:

First building block (101) is composed of two connected cubes, a cuboid, and there are eight corners, which are replaced with protruding balls (11), on up and down side;

Second building block (102) is composed of three connected cubes, a cuboid, and there are eight corners, which are replaced with protruding balls (11), on up and down side;

Third building block (103) is composed of four connected cubes, a cuboid; there are two units on down row and two units on up row; there are eight corners on up and down corners, which are replaced with protruding balls (11):

Fourth building block (104) is composed of six connected cubes, a cuboid; there are three units on up and down row; there are eight corners on up and down corners, which are replaced with protruding balls (11):

Fifth building block (105) is composed of eight connected cubes, a cuboid; there are four units on up and down row; there are eight corners on up and down corners, which are replaced with protruding balls (11):

Sixth building block (106) is composed of five connected cubes and one unit of open gap (12); there are three units on up and down row, but there is one unit loss; there are twelve corners on up and down row, which are replaced with protruding balls (11);

Seventh building block (107) is composed of six connected cubes and two unit of open gap (12); there are four units on up and down row, but there are two unit loss; there are twelve corners on up and down row, which are replaced with protruding balls (11);

Eight building block (108) is composed of seven connected cubes and one unit of open gap (12); there are four units on up and down row, but there is one unit loss; there are twelve corners on up and down row, which are replaced with protruding balls (11).

According to the above description, every twelve edge lines are replaced by protruding balls (11), and the design of protruding balls (11) are better than without. Moreover, there are round convex tables (14) on top and down layers of each building block (10) to make it special, beautiful, good touch quality, and prevent from slippery; thus it is good to have the design of protruding balls (11) than without.

In the description above, three building block (106, 107, and 108) with gap (12) can be compared with their difficulty from hard to easy as the eighth building block (108) to the sixth building block (106); the difficulty of fifth building block (105) are harder than the seventh and eight building block (107 and 108); thus, this invention have the level of difficulty, to entertain, challenge, and motivate players on intellectual activities.

The figures above are better ones chosen out and not for the purpose of limitations the claims; any changes and revised ones with the same effect belongs to this invention.

BRIEF DESCRIPTION OF THE DRAWINGS

FIG. 1-1: shows a decomposition of this overturn building block invention;

FIGS. 1-2 and 1-3: shows the correspondence picture of the cube and flat;

FIG. 1-4: shows the view of a cube;

FIGS. 2-1 to 2-6: shows the overturn of cube on the flat;

FIG. 3: shows first view of the movement of this building block;

FIG. 4: shows second view of the movement of this building block;

FIG. 5: shows the view of bump of this building block;

FIG. 6: shows the movement of this building block on FIG. 5;

Figures 1, 2:
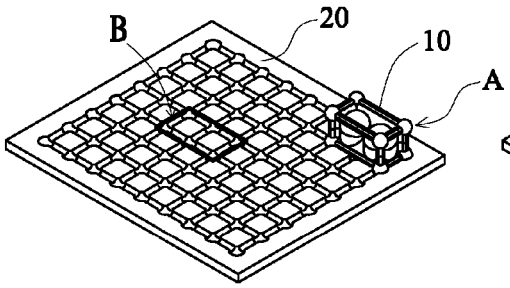
Figure 2:
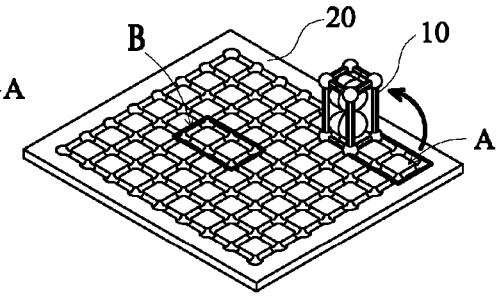
Figures 2, 3:
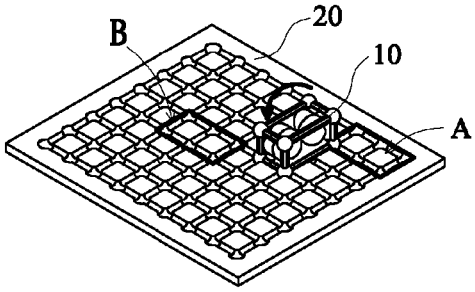
Figures 2, 3, 4:
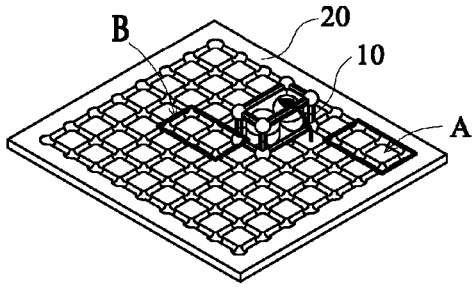
Figures 2, 3, 4, 5:
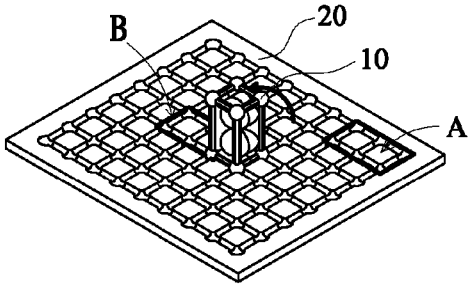
Figures 2, 3, 4, 5, 6:
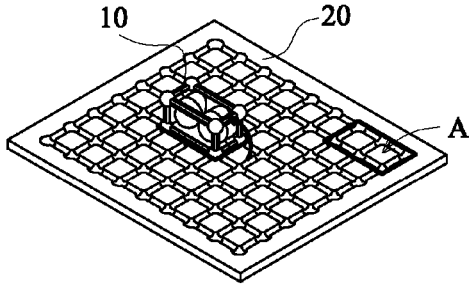
Figure 3:
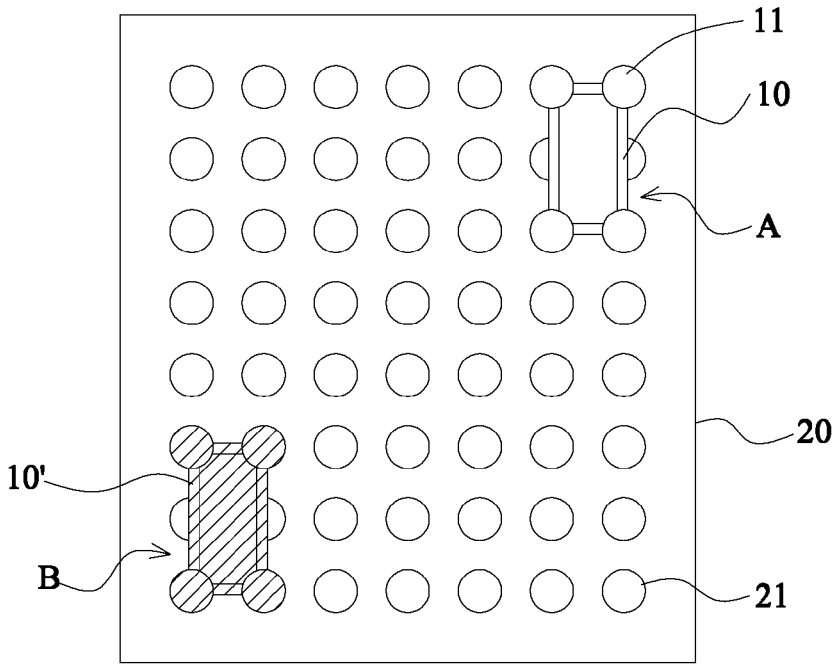
Figure 4:
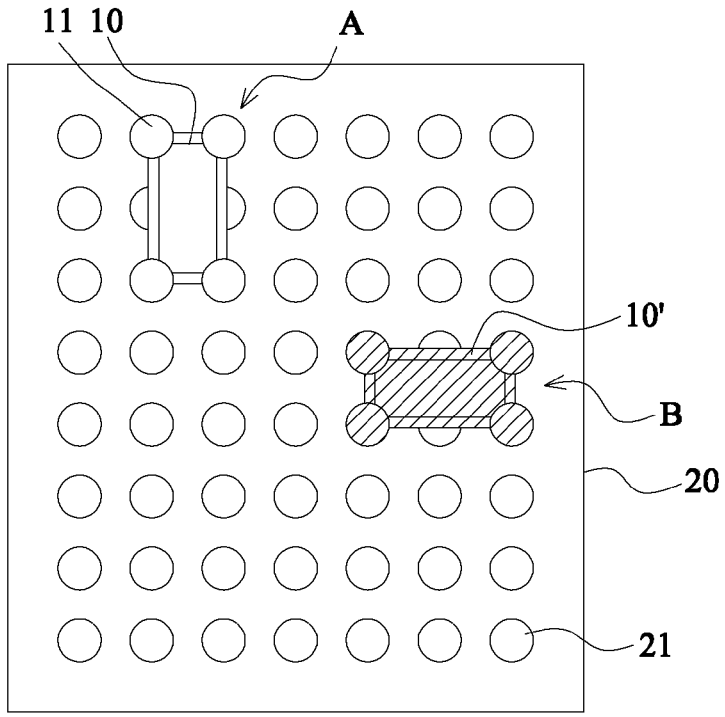
Figure 5:
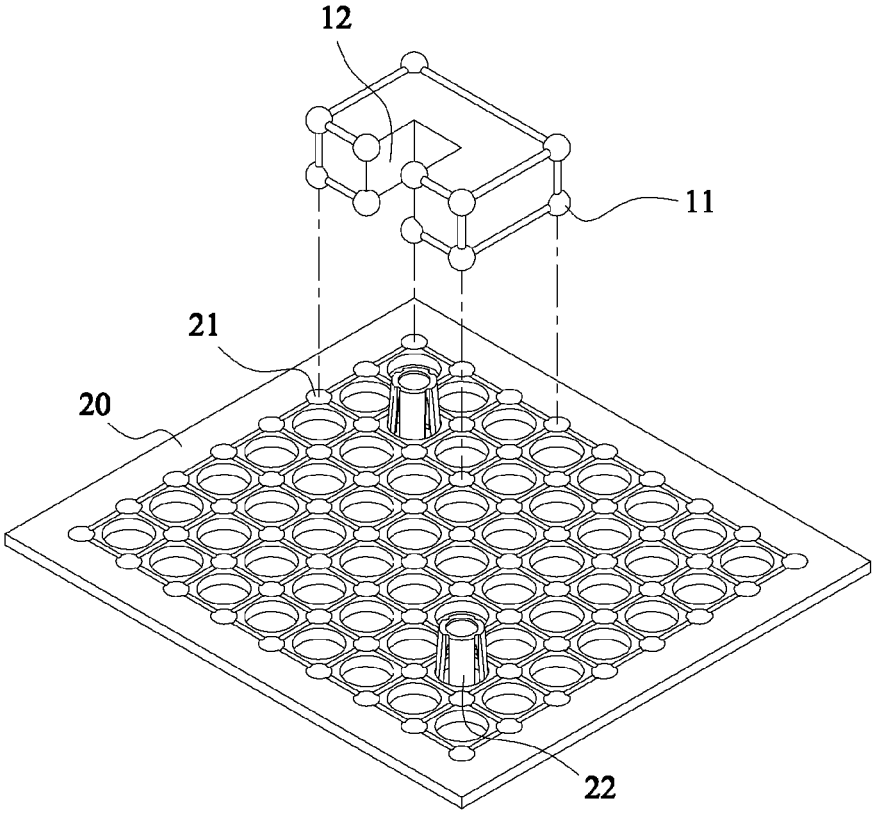
Figure 6:
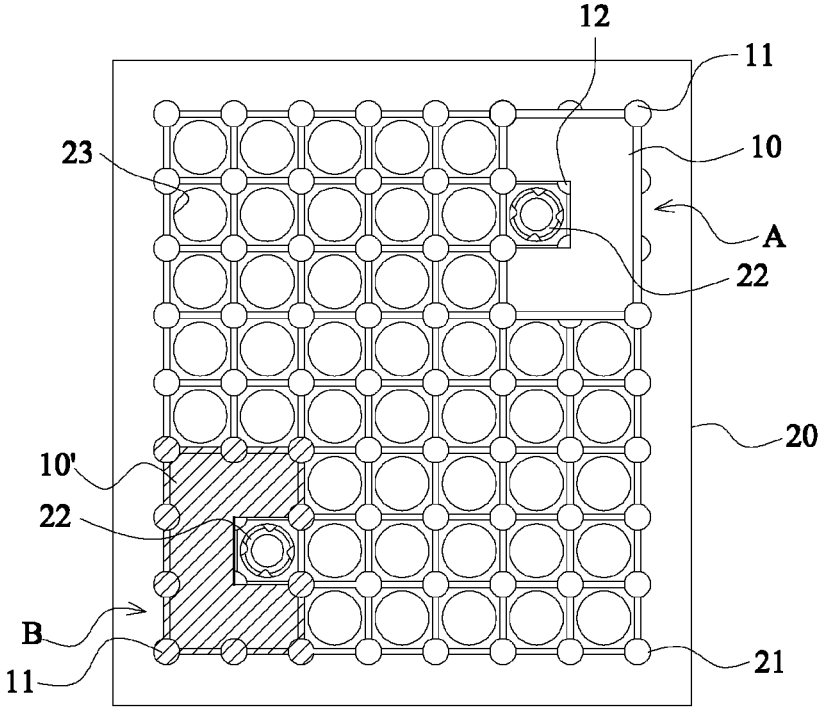
Figure 7:
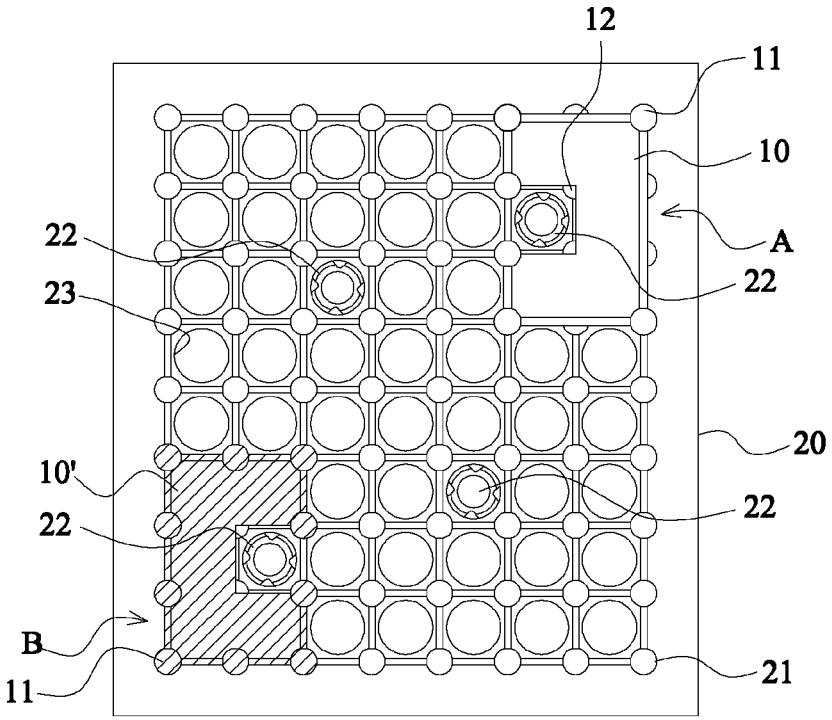
FIG. 7: shows view of the added bump on plate.
Figure 8:
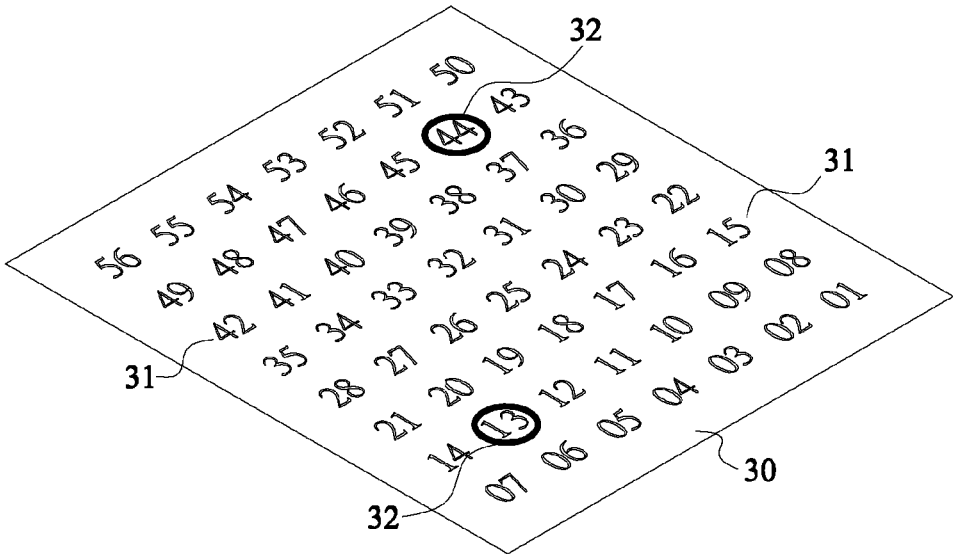
FIG. 8: shows the 3-Dimensional view of this building block.
Figure 9:
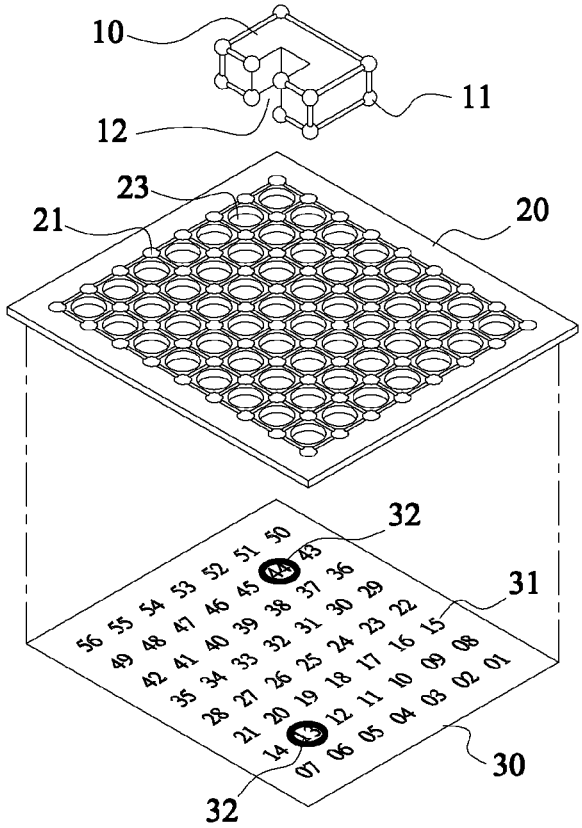
FIG. 9: shows the assemble of card, flat, and block on FIG. 8.
Figure 10:
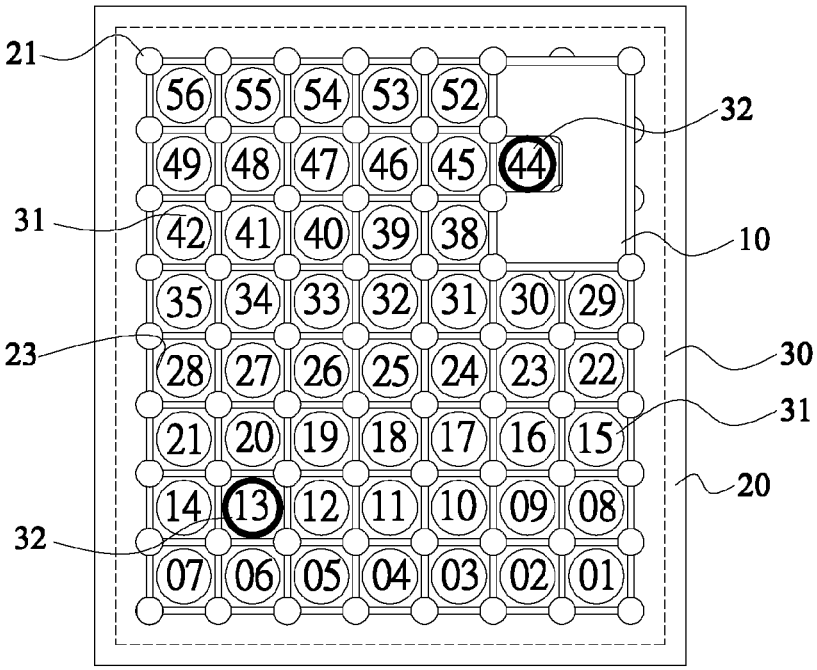
FIG. 10: shows the plane view of cube on flat of FIG. 9.
Figure 11:
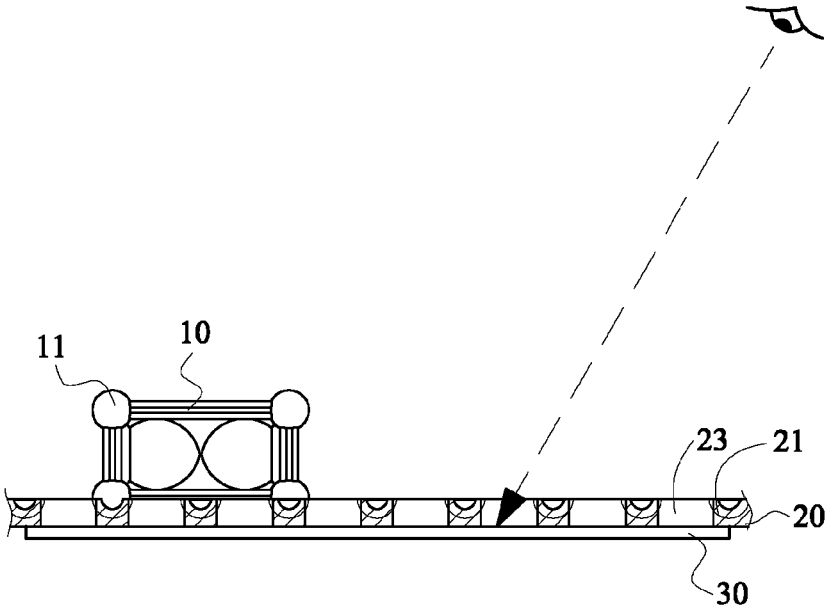
FIG. 11: shows the card view of FIG. 9 from naked eyes.
Figure 12:
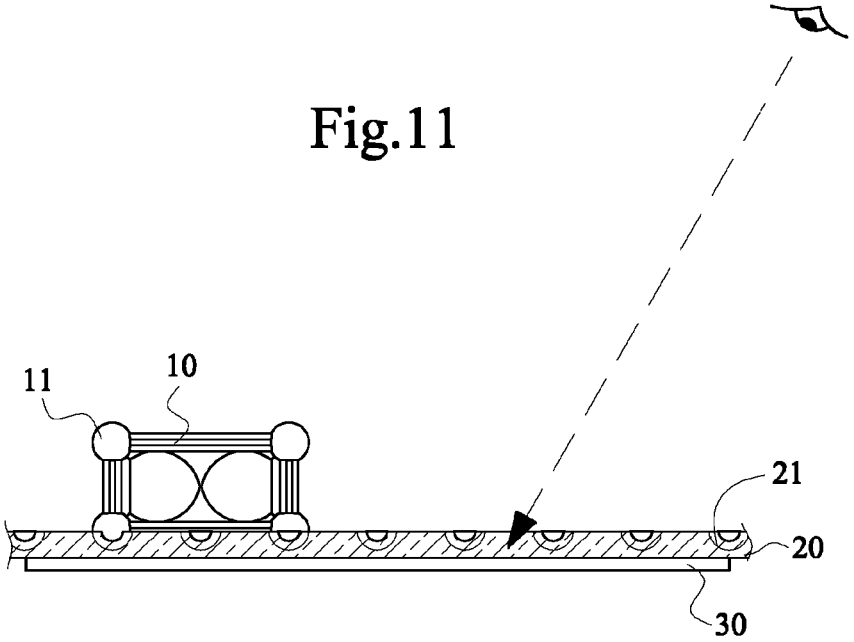
FIG. 12: shows the view under flat from naked eyes.
Figure 13:
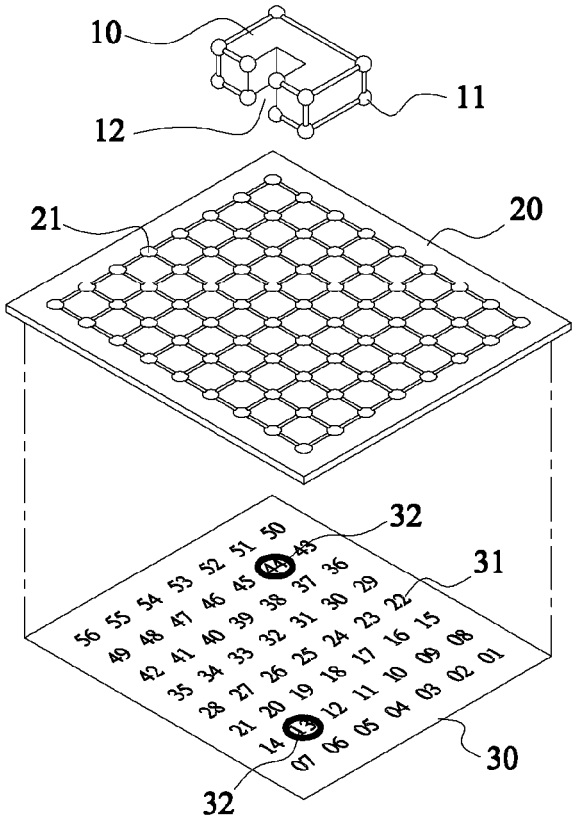
FIG. 13: shows the assemble of card, flat and cube of FIG. 12.
Figure 14:
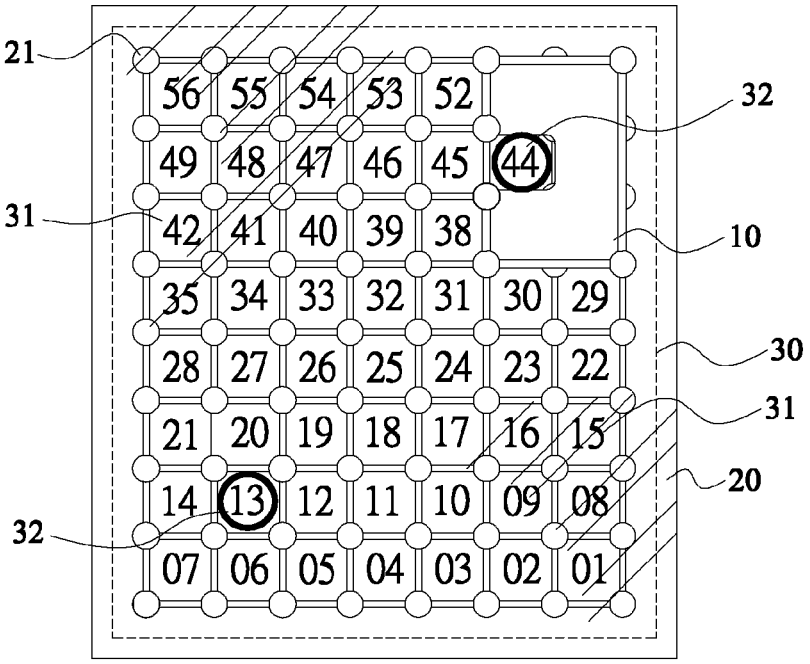
FIG. 14: shows the plane view of cube and flat of FIG. 13.
Figure 15:
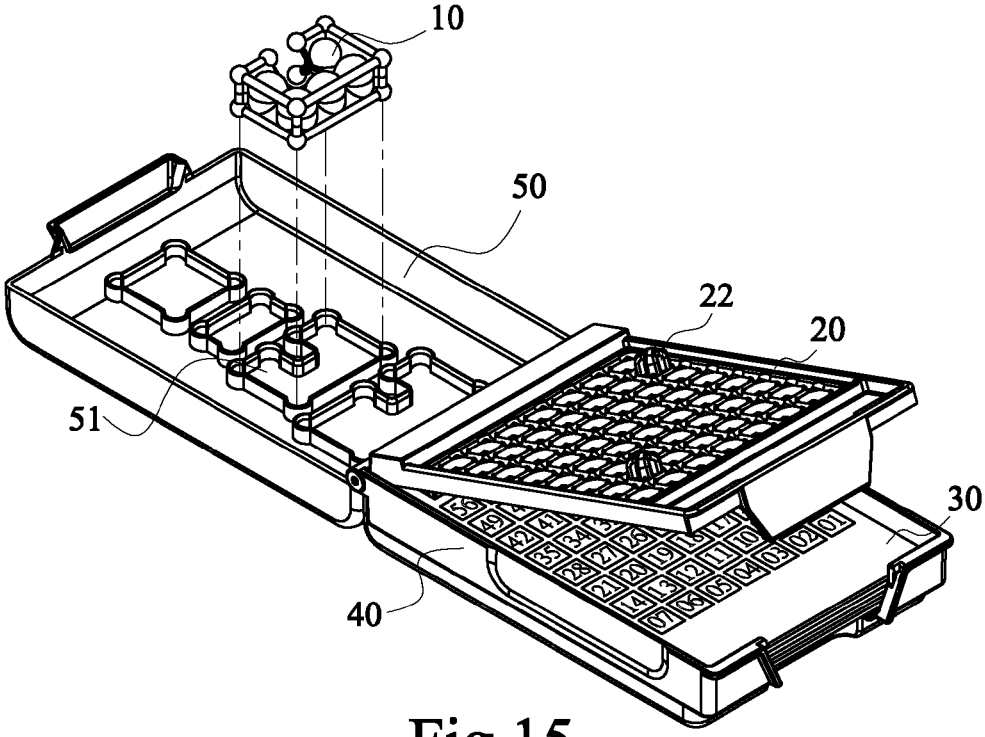
FIG. 15: shows the 3-Dimensional view of connection of flat, cover, and card box.
Figure 16:
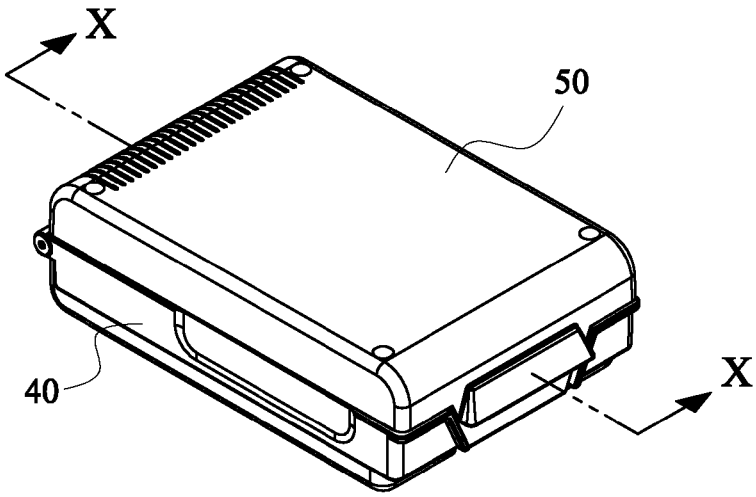
FIG. 16: shows 3-Dimensional assemble view of FIG. 15.
Figure 17:
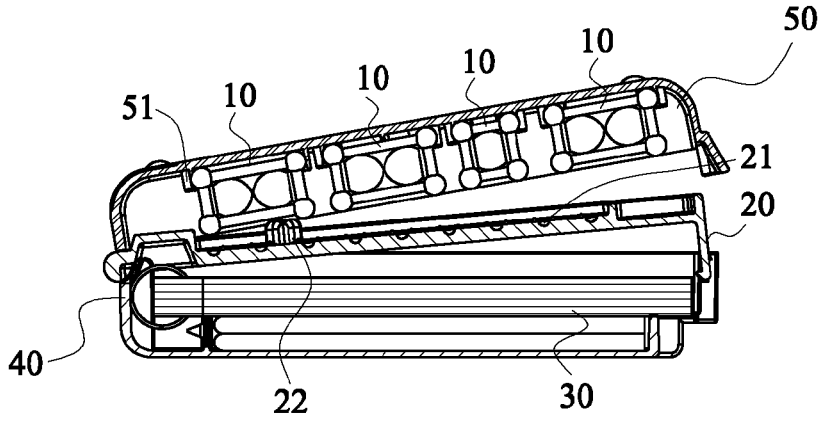
FIG. 17: shows the X-X cutaway view of FIG. 16.
Figure 18:
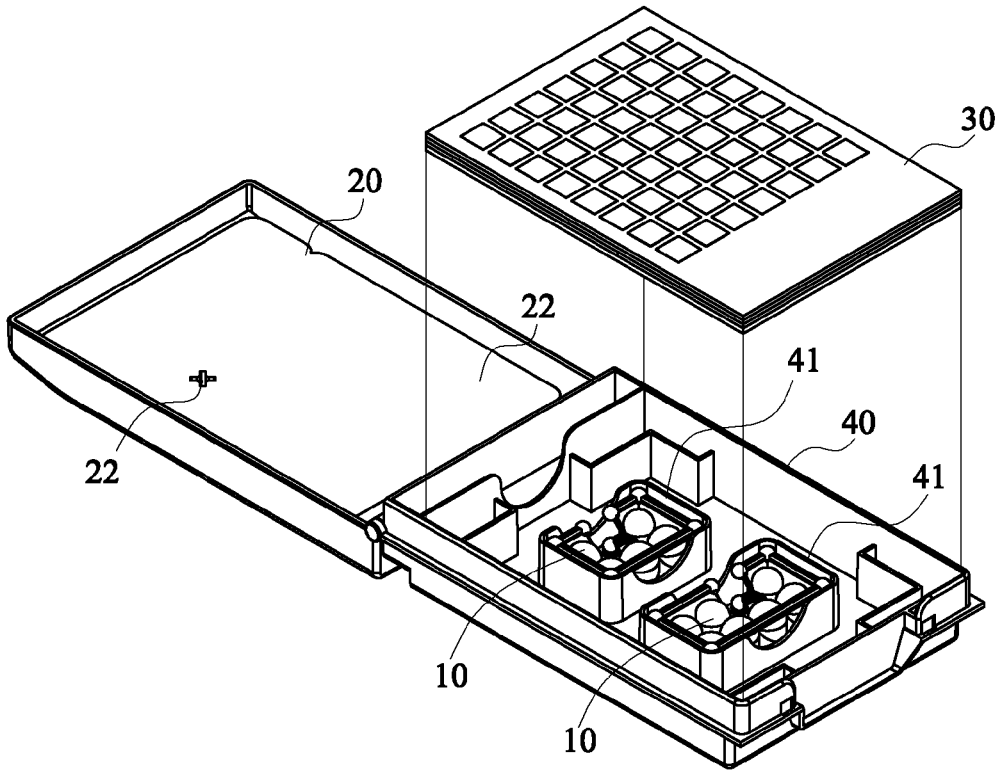
FIG. 18: shows the 3-Dimensional assemble of flat with another card box.
Figure 19:
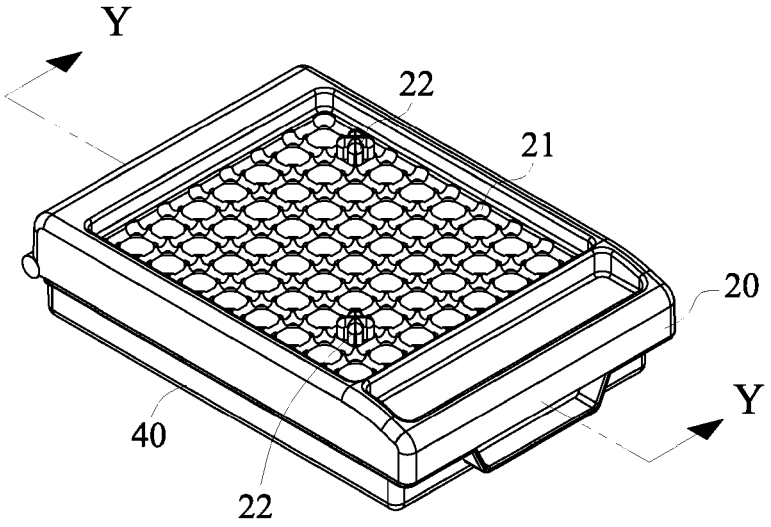
FIG. 19: shows the 3-Dimensional view of FIG. 18 after assemble.
Figure 20:
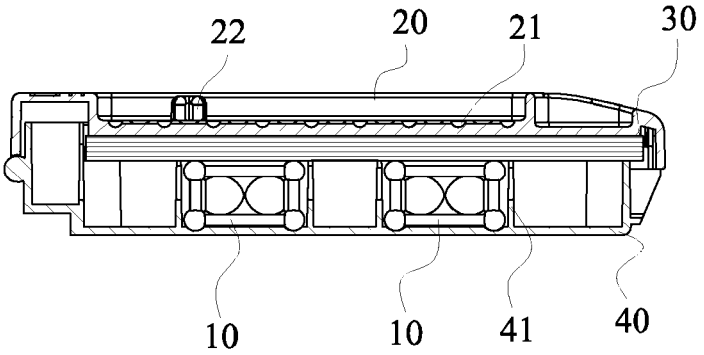
FIG. 20: shows the Y-Y cutaway VIEW OF FIG. 19.
Figure 21:
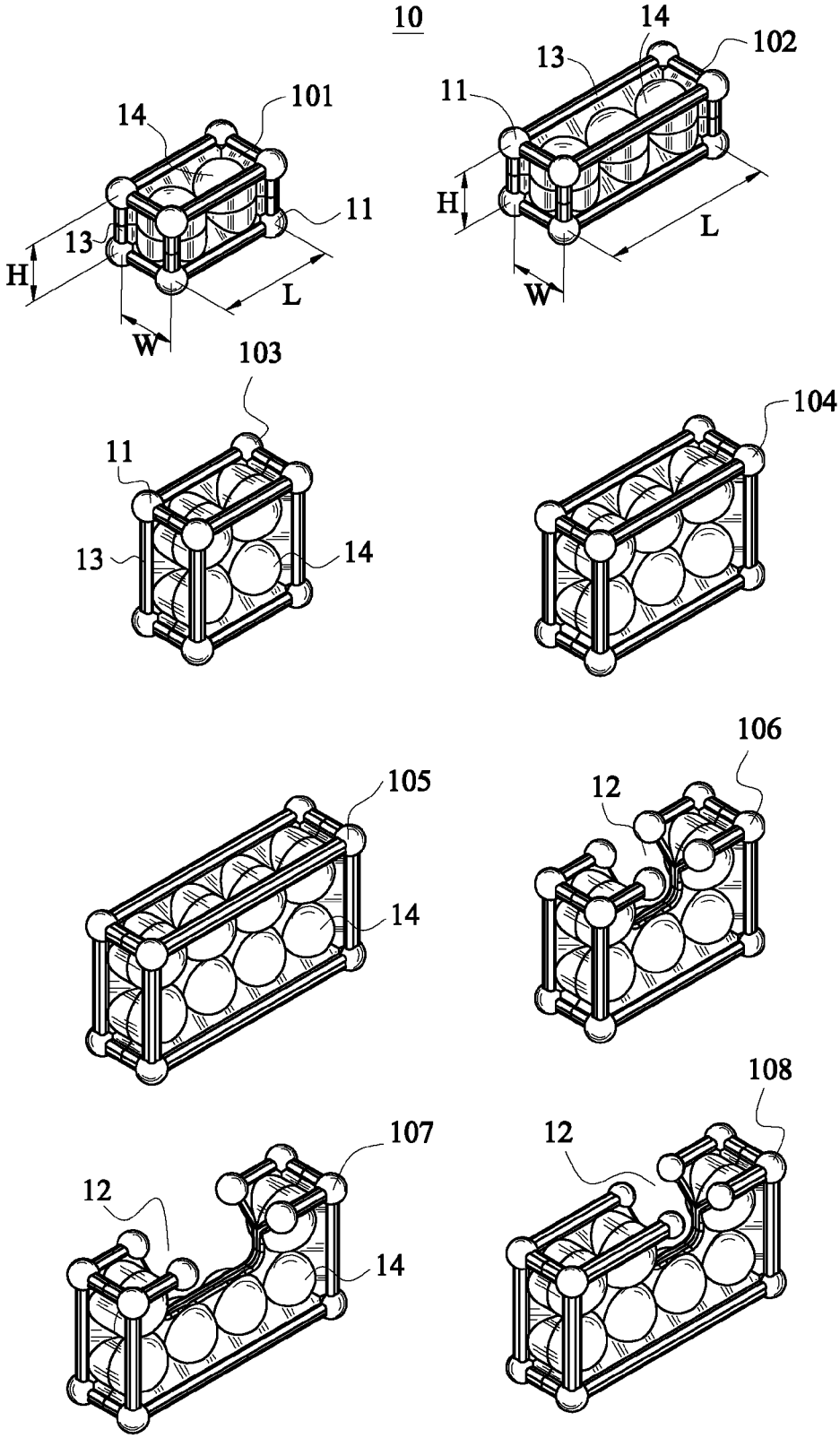
FIG. 21: shows the 3-Dimensional view of 8 cubes.

What is claimed is:

1. A game apparatus for allowing players to turnover building blocks comprising;

a set of two eight overturn building block cubes having at least twelve arc lines forming edges each being connected at least eight corners having equal diameter balls, a flat for placement of said overturn building block cube thereon and having an array of circular arc-shaped dimple holes for functioning with the balls of the building block cubes arranged equidistant equal to an arc line of said overturn building block cubes, wherein an overturn building block cube can be placed upon said flat with said balls in said holes such that they can be rotated and turned over upon said flat from one set of holes to a next about an axis defined by an arc line.

2. A game apparatus according to claim 1, wherein said flat further comprises a bump surrounded by four holes to impede a building block cube from being turned over from one set of holes to a next.

3. A game apparatus according to claim 2, wherein said building block has an open gap equal in dimensions to said distance of said arc-shaped dimple holes of said flat such said gap can impede the rotation and turnover of a building block cube.

4. A game apparatus according to claim 1 further comprising a card with marks for placement under said flat and wherein said flat is designed with a hollow through area between each hole such people can see said card and its marks through said hollows, said marks further comprising indicia for indicating a bump intended to impede the turnover of a building block cube.

5. A game apparatus according to claim 1 further comprising a card with marks for placement under said flat and wherein said flat is designed with a transparent body such people can see said card and its marks through transparent flat, said mark further comprising indicia for indicating a bump intended to impede the turnover of a building block cube.

6. A game apparatus according to claim 1, wherein said flat further comprises a card box on an underside for holding said cards.

7. A game apparatus according to claim 6, wherein said card box further comprises a frame slot to place at least one building block for storage beneath said card.

8. A game apparatus according to claim 1, wherein said flat further comprises at least one frame slot to place building block cube.

9. A game apparatus according to claim 1, wherein said holes are connected with an arc groove in said flat correspond to and capable of receiving an arc line forming an edge of a building block cube.

10. A game apparatus according to claim 1, wherein said building block cube has an up and down side and a width equal to a distance between two holes on said flat and a shape selected from the following, a first building block with eight corners composed of two connected cubes forming a cuboid with eight protruding balls at each corner on said up and down side, a second building block composed of three connected cubes forming a cuboid with eight protruding balls at each corner on said up and down side, a third building block composed of four connected cubes forming a cuboid with eight protruding balls at each corner on said up and down side, of which two units on down row and two units on up row, a fourth building block composed of six connected cubes forming a cuboid with eight protruding balls at each corner on said up and down side, of which three units on down row and three units on up row, a fifth building block composed of eight connected cubes forming a cuboid with eight protruding balls at each corner on said up and down side, of which three units on down row and three units on up row, a sixth building block composed of five connected cubes and one unit of open gap with twelve protruding balls at each corner on said up and down side, of which three units on down row and three units on up row but missing one unit in the middle of row, a seventh building block composed of six connected cubes and two units of open gap with twelve protruding balls at each corner on said up and down side, of which four units on down row and four units on up row but missing two units in the middle of row, an eighth building block composed of seven connected cubes and one unit or open gap with twelve protruding balls at each corner on said up and down side, of which four units on down row and four units on up row but missing one unit in the middle right of row.

* * * * *